US006550939B2

(12) United States Patent
Reinert

(10) Patent No.: US 6,550,939 B2
(45) Date of Patent: Apr. 22, 2003

(54) LIGHT BEAM SHUTTER APPARATUS

(75) Inventor: Travis J. Reinert, Rowlett, TX (US)

(73) Assignee: Vari-Lite, Inc., Dallas, TX (US)

( * ) Notice: Subject to any disclaimer, the term of this patent is extended or adjusted under 35 U.S.C. 154(b) by 0 days.

(21) Appl. No.: 09/953,537

(22) Filed: Sep. 12, 2001

(65) Prior Publication Data

US 2003/0048640 A1 Mar. 13, 2003

(51) Int. Cl.[7] ..... F21V 17/02

(52) U.S. Cl. ..... 362/321; 362/277; 362/284; 359/227; 359/236

(58) Field of Search ..... 362/277, 280, 362/281, 282, 283, 284, 319, 320, 321, 322, 323, 324, 307, 311; 353/62, 80, 120; 359/227, 233, 234, 235, 236

(56) References Cited

U.S. PATENT DOCUMENTS

| | | | | |
|---|---|---|---|---|
| 1,767,756 A | | 6/1930 | Hall | |
| 2,076,240 A | | 4/1937 | Levy | |
| 2,950,382 A | | 8/1960 | Hatch | |
| 3,307,028 A | | 2/1967 | Frederick | |
| 3,571,588 A | | 3/1971 | Hilzen | |
| 3,594,566 A | | 7/1971 | Kneisley | |
| 4,208,100 A | | 6/1980 | Bischl | |
| 4,210,955 A | | 7/1980 | Labrum | |
| 4,232,359 A | | 11/1980 | Leon et al. | |
| 4,468,720 A | | 8/1984 | Arai | |
| 4,729,018 A | * | 3/1988 | Watanabe et al. | 348/69 |
| 4,890,208 A | | 12/1989 | Izenour | |
| 5,446,637 A | | 8/1995 | Cunnigham et al. | |
| 5,510,969 A | | 4/1996 | Rodger et al. | |
| 5,791,755 A | * | 8/1998 | Henry et al. | 353/120 |
| 5,825,548 A | * | 10/1998 | Bornhorst et al. | 359/578 |
| 5,904,417 A | | 5/1999 | Hewett | |
| 6,241,366 B1 | * | 6/2001 | Roman et al. | 362/293 |

FOREIGN PATENT DOCUMENTS

| | | |
|---|---|---|
| EP | 0 684 424 A1 | 11/1995 |
| GB | 2 270 969 A1 | 3/1994 |

OTHER PUBLICATIONS

PCT WO 96/36834; World Intellectual Property Organization; Nov. 21, 1996; Peter Johansen.
PCT WO 01/84043 A1; World Intellectual Property Organization; Nov. 18, 2001; Thomas Brockmann, et al.

* cited by examiner

*Primary Examiner*—Stephen Husan
*Assistant Examiner*—John Anthony Ward
(74) *Attorney, Agent, or Firm*—Carr Law Firm, L.L.P.

(57) ABSTRACT

A light beam shutter apparatus for a lighting instrument includes several individual shutter mechanisms arranged radially around the axis of a light beam. Each shutter mechanism includes a generally circular shutter blade having a circumference, but with a cut-out or void area such that a portion of the circumference is eliminated. The shutter blade preferably includes at least one straight edge at the boundary of the cut-out or void area, which straight edge passes through the center around which the shutter blade rotates, and is used for intercepting at least a portion of a light beam passing through the light beam shutter apparatus. The shutter blade may alternatively include other edge shapes at the boundary of the cut-out or void area, as desired. Driven surfaces, such as gear teeth or the like, are formed in opposed portions of the remaining circumference. The shutter blade is mechanically coupled to linear driving members, such as rack gears or the like, which are driven in turn by rotary driving members, such as pinions or the like. The rotary driving members may be driven by motors. Linear-actuating motors may also be used to drive the linear driving members in place of rotary motors and rotary driving members. The shutter mechanism assembly, comprising the several similar shutter mechanisms, may be rotated through a limited range, as desired.

35 Claims, 8 Drawing Sheets

LIGHT BEAM SHUTTER APPARATUS

FIELD OF THE INVENTION

The present invention relates to a shutter apparatus for use with lighting sources, particularly stage lighting instruments, whereby the size and shape of a light beam projected by the lighting source may be varied.

DESCRIPTION OF RELATED ART

Framing shutters have been used in stage lighting instruments, or luminaires, to vary the size and shape of a light beam projected. Typically, four manually adjustable blades having straight edges are inserted through slots in the housing of a spot light luminaire at a position along the optical system of the luminaire, such as at a projection gate, where an image may be formed and projected. These framing shutters are often used to "frame" a normally circular or ellipsoidal spot of light into a rectangular or other quadrilateral form, such as to simulate the effect of sunlight shining through a rectangular window and casting a quadrilateral patch of light on a floor.

Examples of framing shutters are well known in the art as illustrated, for example, in U.S. Pat. Nos. 1,767,756; 2,076,240; 2,950,382; 3,307,028; 3,571,588; 3,594,566; 4,208,100; 4,210,955; 4,232,359; 4,468,720; 4,890,208; 5,446,637; 5,510,969; 5,904,417; and in other patent publications including GB-A-2270969 and WO-A-96/36834.

Prior implementations of framing shutters have been developed to provide three main features or functions. Shutter blades can be moved orthogonally into a light beam to form a rectangular beam. Shutter blades can be skewed non-orthogonally to form a trapezoidal or other non-orthogonal beam. The set of shutter blades can be rotated as a unit around the longitudinal axis of a light beam to rotate the resulting shape of the beam, as desired. The shutter blade apparatus is made as thin as possible to keep the shutter blades within the depth of field of a spotlight optical system, while making the shutter blades heat resistant so they do not warp.

Shutter blades are made large (wide) so they can be moved non-orthogonally and still intercept the light beam. This requires a large amount of space within the plane of movement of each shutter blade to afford this freedom of movement.

Prior implementations of framing shutters for motorized and remote-controlled lighting instruments, particularly for stage lighting or other entertainment lighting applications, require pivot couplings or other linkages between the shutter blades and the driving mechanisms. These couplings and linkages require additional components, thereby increasing the depth or thickness of each mechanism, which increases both the cost and complexity of the framing shutter apparatus. Installation of the couplings increases the complexity of manufacturing the framing shutter apparatus.

SUMMARY OF THE INVENTION

The invention provides a simple and inexpensive light beam shutter control method and apparatus for use in a luminaire or other light projection device. The present invention comprises one or more shutter blades having at least one edge for intercepting at least a portion of a beam of light projected by the light projection device and a pair of curved driven surfaces formed in the periphery of the shutter blade. A pair of linear driving elements is coupled to the shutter blade at the driven surfaces to extend and retract the blade to position the blade edge into and out of the beam of light.

In one aspect of the invention, each of the linear driving elements can be actuated independently and in opposite directions relative to the periphery of the shutter blade to rotate the blade and the blade edge relative to the light beam.

In another aspect of the invention, the light beam shutter apparatus may include a plurality of shutter blade mechanisms in various orientations and assembled as a shutter mechanism assembly, which may be rotated about a central axis through which a beam of light passes.

DETAILED DESCRIPTION

Figure 1:
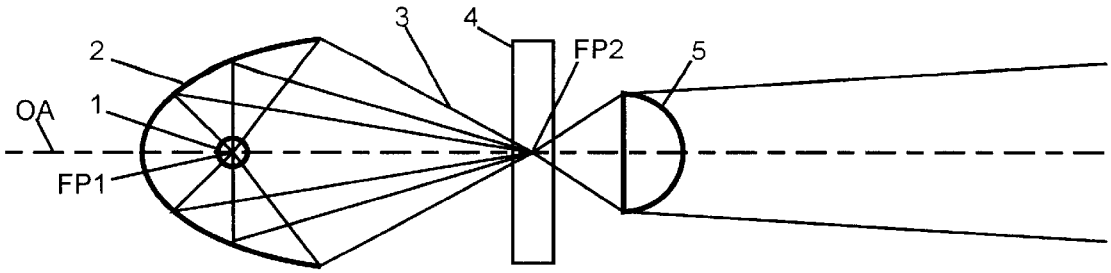
FIG. 1 is a diagram of a typical spot light optical system.

FIG. 1 shows a typical optical system for a spot light luminaire; a particular variety of stage lighting instrument. A lamp 1 coupled with an ellipsoidal reflector 2 project a beam of light—or light beam 3—along an optical axis OA. The lamp is located at or near a first focal point FP1 of the reflector. The lamp and reflector combined form an illumination system for illuminating a projection gate. Alternatively, the illumination system may include a lamp coupled with a spherical or other reflector and a condenser lens. A projection gate apparatus 4 is located along the optical axis near a minimal focus of the illumination system, such as second focal point FP2 of the reflector. The projection gate apparatus typically controls the shape of the light beam, including the forming of images in the projected light beam. A projection lens 5 located along the optical axis projects an image of an illuminated object located at the projection gate apparatus, the projected image being formed some distance beyond the projection lens and in front of the spot light luminaire.

A typical projection gate apparatus may provide for insertion of light pattern generators (such as liquid crystal devices or digital mirrors), light stencils or gobos to be projected by the spot light luminaire or other light projection device. The present invention provides framing for altering the shape of the light beam to a quadrilateral of other geometric profile, depending principally on the number of shutters used and the shape of the shutter edges used. The present invention may be used alone in a typical projection gate apparatus or in combination with one or more other devices, such as a gobo, light stencil, light pattern generator, iris diaphragm, or other such device.

A light beam shutter apparatus according to the present invention comprises one or more shutter mechanisms. In a preferred embodiment, four mechanisms are utilized as overlain layers, as will be described below, but fewer layers of mechanisms could be used or more layers of mechanisms could be used, as desired. Each shutter mechanism includes one shutter blade and associated driving elements for moving the shutter blade to intercept at least part of the light beam passing through the light beam shutter apparatus.

Figure 2:
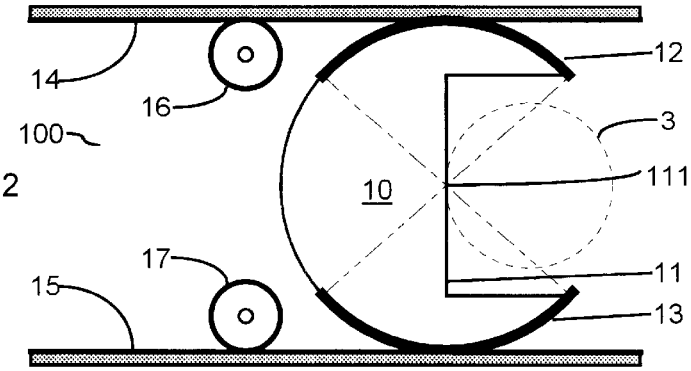
FIG. 2 is a diagram of a shutter blade mechanism according to a first embodiment of the present invention.

As shown in FIG. 2, a shutter blade 10 is generally circular but with a generally rectangular cut-out area or void portion bounded by at least one straight edge 11. In a preferred embodiment, the diameter of the shutter blade 10 is at least twice the diameter of the light beam 3 at the point along the optical axis where the shutter blade is disposed, and the straight edge 11 passes through the center of the shutter blade. This arrangement has at least three particular advantages: the cut-out area is large enough to permit unobstructed passage of the light beam, as desired; the remaining portion of the shutter blade is large enough to completely block passage of the light beam, as desired; and the straight edge which intercepts the light beam can be rotated about its center, as desired. Although the shutter blade 10 is configured in a preferred embodiment with a straight edge 11, as is shown in FIG. 2, it will be appreciated that the shutter blade 10 could alternatively be configured with an edge having a variety of profiles or shapes to create the desired shape of the edge of the beam of light 3 blocked or occluded. It will also be apparent that the diameter of the shutter blade 10 relative to the light beam 3 and the location of the edge 11 of the shutter blade 10 may be modified as desired to create the desired shutter effect.

Since the shutter blade 10 is generally circular and the straight edge 11 intercepting the light beam passes through the center 111 of the circle, the straight edge intercepting the light beam can be rotated about its center, as desired. The center point 111 of the straight edge 11 is coincident with the center of rotation of the shutter blade. This provides for a particular advantage compared with prior art shutter blades for which a center of rotation is not constrained to the center of the intercepting edge. Such prior art shutter blades must be afforded room to pivot about a point offset from the geometric center of the blade and therefore sufficient space must be provided within the shutter blade mechanism to permit the shutter to swing from side to side or up and down, as the case may be. In the preferred embodiment described herein, the shutter blade may be rotated about its center and therefore remains in its position without swinging from side to side or up and down. No additional space is required within the mechanism to allow for such pivotal or rotational movement. The shutter blade according to the preferred embodiment only requires sufficient additional space, beyond the space it occupies at any given position, to allow the shutter blade to be linearly extended into or withdrawn from the path of the light beam. Another advantage of this configuration is that the shutter blade can be made smaller because the need to swing the intercepting edge of the blade is eliminated.

Rotation and linear movement or actuation of the shutter blade 10, to position the blade 10 and the edge 11 in the rotational orientation and location with respect to the light beam 3 as desired, is accomplished by actuation of a shutter control mechanism 100. The shutter control mechanism 100 comprises a portion of the circumference of the shutter blade provided with a driven surface 12 and an opposite portion of the shutter blade provided with a driven surface 13. The driven surfaces 12 and 13 are formed as a series of gear teeth, for example. A linear driving element 14 contacts the driven surface 12 and is coupled to a rotary driving element 16. A linear driving element 15 contacts the driven surface 13 and is coupled to a rotary driving element 17. Where driven surfaces 12 and 13 are gear teeth, linear driving elements 14 and 15 are preferably rack gears, and rotary driving elements 16 and 17 are preferably pinions. The rotary driving elements 16 and 17 are preferably coupled to separate motors (not shown). Each of the driven surfaces 12 and 13 contacting the first and second linear driving elements of the shutter blade are substantially circular and share substantially the same center of curvature, preferably at approximately the center of the generally circular shutter blade 10. The shutter control mechanism 100 is preferably capable of positioning the shutter blade 10 in continuously variable linear positions and rotational orientations along its range of movement and with a continuously variable rate of change or speed. Linear actuation of the shutter blade 10, substantially independently of rotation with respect to the light beam 3, is accomplished by movement of both of the linear driving elements 14 and 15 in substantial synchrony with each other. Synchronous movement of the linear driving elements 14 and 15 comprises their linear actuation and resulting translation or movement in the same direction, toward or away from the light beam 3, and at the same rate or speed. It will be apparent that synchronous movement of the linear elements 14 and 15 results in substantially no displacement or movement of the linear driving elements 14 and 15 relative to the shutter 10, at the points of connection of the elements to the shutter blade 10. More specific examples of performing such linear actuation of the shutter blade 10 in one embodiment of the invention are shown and described in connection with FIGS. 3 and 4.

Rotation of the shutter blade 10, substantially independently of or in combination with linear actuation of the shutter blade 10 with respect to the light beam 3, is accomplished by movement of either or both of the linear driving elements 14 and 15 out of synchrony with or asynchronously with each other. For example, actuation and resulting movement of driving elements 14 and 15 asynchronously would comprise actuation and resulting movement of one of the elements, while the other element is not actuated or is preferably secured against movement by its associated rotary driving element 16 or 17. Also comprising asynchronous movement of the linear driving elements 14 and 15 would be actuation and resulting movement of both of the elements in opposite directions relative to the shutter blade 10, as well as movement of both of the linear driving elements 14 and 15 in the same direction relative to the shutter 10 at different speeds relative to each other. More specific examples of performing such actuation of the shutter blade 10 in one embodiment of the invention are shown and described in connection with FIGS. 5 and 6.

Figure 3:
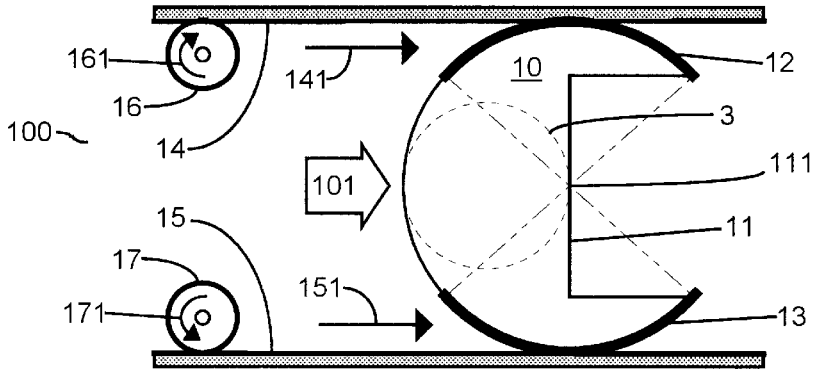
FIGS. 3–6 are diagrams showing the operation of the shutter blade mechanism according to a first embodiment of the present invention.

When rotary driving elements 16 and 17 are rotated in opposite directions shown by arrows 161 and 171, respectively, in FIG. 3, linear driving elements 14 and 15 are moved in the same direction, as is shown by arrows 141 and 151, respectively. This action carries shutter blade 10 toward a relatively extended position intercepting and partly or wholly blocking the light beam 3, in a direction shown by arrow 101. In the fully extended position, shutter blade 10 completely intercepts the light beam 3, as shown in FIG. 3, and represents a practical limit of travel for the shutter blade mechanism.

The rotary elements 16 and 17 are shown located on the same side of their respectively associated linear driving elements 14 and 15, as is the shutter blade 10, providing the advantages of reducing space requirements and requiring the formation of gear teeth on only one side of the elements 14 and 15. The gear teeth of the linear driving elements 14 and 15, the rotary elements 16 and 17 and the shutter blade 10 are preferably of substantially the same pitch, thus allowing overlap of the travel of the rotary elements 16 and 17 and the shutter blade 10 along the same teeth of the linear driving elements 14 and 15.

Figure 4:
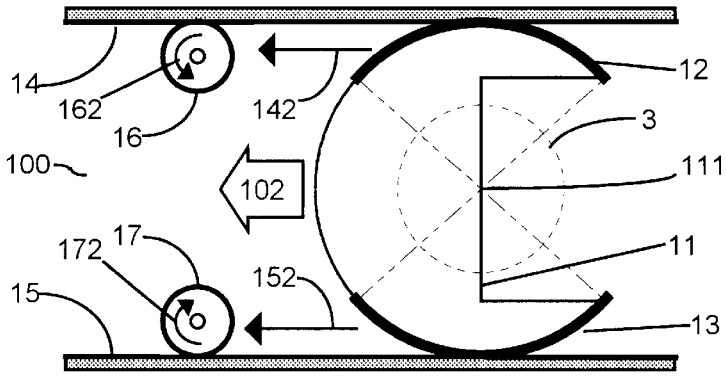

When rotary driving elements 16 and 17 are rotated in directions shown by arrows 162 and 172, respectively, in FIG. 4, linear driving elements 14 and 15 are moved in the same direction shown by arrows 142 and 152, respectively. This action carries the shutter blade 10 in a direction shown by arrow 102, toward a relatively retracted position that intercepts or blocks less light beam 3 than when in the fully extended position or blocks none of the light beam 3. In the partially retracted position, shutter blade 10 intercepts half of light beam 3, as shown in FIG. 4, and represents a midpoint of practical travel for the shutter blade mechanism 100. If rotary driving elements 16 and 17 continue to rotate in the directions shown by arrows 162 and 172, respectively, the shutter blade 10 will eventually be carried back to the position shown in FIG. 2, which represents another practical limit of travel for the shutter blade mechanism 100. The shutter blade could be withdrawn farther from the beam path than the position shown in FIG. 2, for cleaning, maintenance or other purposes, if desired.

Figure 5:
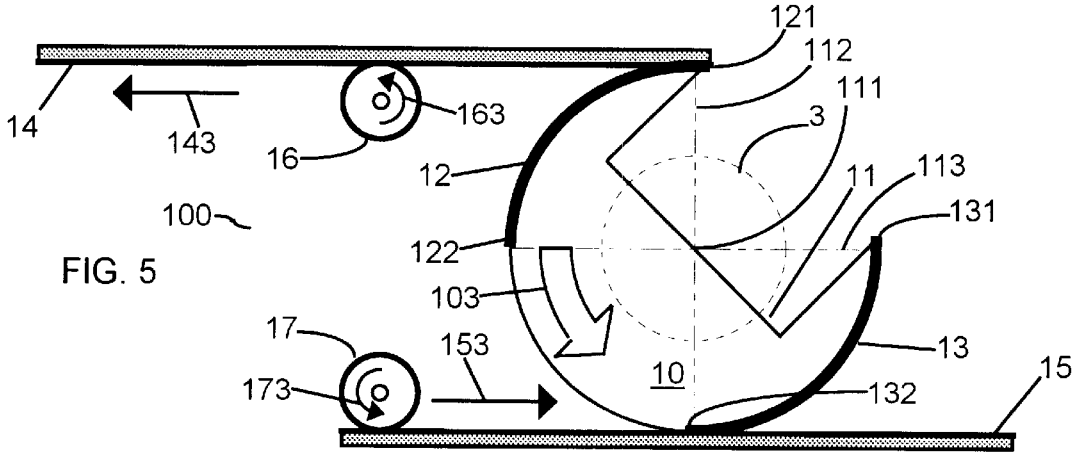

With the shutter blade 10 in a midpoint position, as shown in FIG. 4, rotary driving elements 16 and 17 can be driven in the same direction, as shown by arrows 163 and 173, respectively, in FIG. 5. This activates or drives linear driving elements 14 and 15 in opposite directions shown by arrows 143 and 153, respectively, rotating shutter blade 10 in a counter-clockwise direction, shown by arrow 103, varying that portion of the light beam 3 intercepted by the shutter blade 10 and the alignment of the blade edge 11 with respect to the light beam 3. The position of shutter blade 10 shown in FIG. 5 represents a practical limit of rotational travel in the counter-clockwise direction, wherein straight edge 11 has been rotated through 45 degrees from the position shown in FIG. 2. Preferably, the driven surface 13 extends only as far as point 132 on the circumference of the shutter blade 10, at which point the array of gear teeth forming the surface 13 ends and, if desired, a stop (not shown) is positioned to obstruct further movement of the associated linear driving element 15. The driven surface 12 similarly extends only as far as point 121, at which point the array of gear teeth forming the surface 13 ends and, if desired, a stop (not shown) is positioned to obstruct further movement of the associated linear driving element of the array of gear teeth forming the surface 12 ends and, if desired, a stop (not shown) is positioned to obstruct further movement of the associated linear driving element 14. This prevents the shutter blade 10 from becoming mechanically uncoupled from the linear driving elements 14 and 15 as a result of over-driving the shutter blade mechanism in the counter-clockwise direction past the opening formed by the straight edge 11 of the shutter blade 10.

Figure 6:
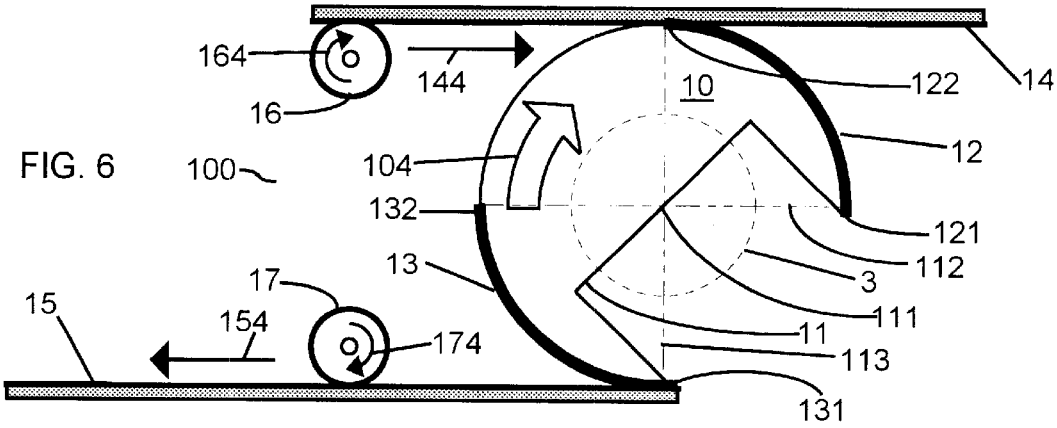

Rotary driving elements 16 and 17 can be driven in the same direction as shown by arrows 164 and 174, respectively, in FIG. 6. This activates or drives linear driving elements 14 and 15 in opposite directions shown by arrows 144 and 154, respectively, rotating shutter blade 10 in a clockwise direction shown by arrow 104, varying that portion of the light beam 3 intercepted by the shutter blade 10 and the alignment of the blade edge 11 with respect to the light beam 3. The position of shutter blade 10 shown in FIG. 6 represents a practical limit of rotational travel in the clockwise direction, wherein straight edge 11 has been rotated through 90 degrees from the position shown in FIG. 5, or through 45 degrees from the position shown in FIG. 2. Preferably, the driven surface 12 extends only as far as point 122 on the circumference of the shutter blade 10, at which point the array of gear teeth forming the surface 12 ends and, if desired, a stop (not shown) is positioned to obstruct further movement of the associated linear driving element 14. The driven surface 13 similarly extends only as far as point 131, at which point the array of gear teeth forming the surface 13 ends and, if desired, a stop (not shown) is positioned to obstruct further movement of the associated linear driving element 15. This prevents the shutter blade 10 from becoming mechanically uncoupled from the linear driving elements 14 and 15 as a result of over-driving the shutter blade mechanism in the clockwise direction past the opening formed by the straight edge 11 of the shutter blade 10.

Figure 7:
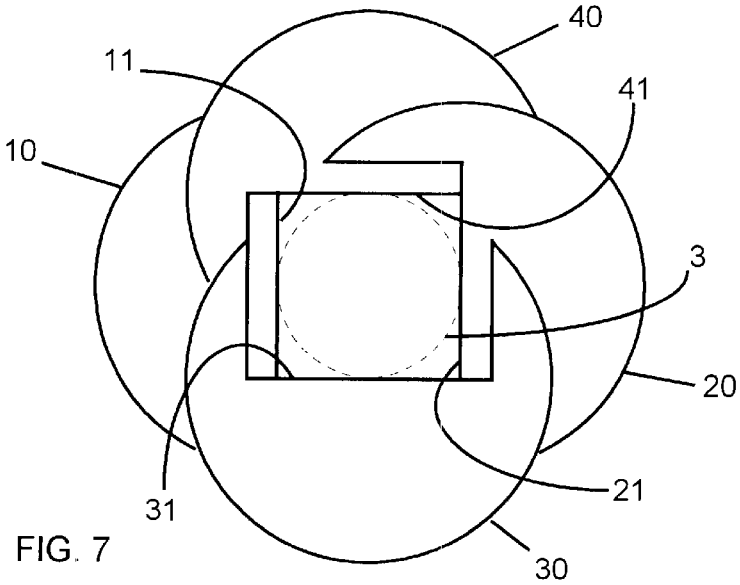
FIGS. 7–9 are diagrams showing the operation of shutter blades of a shutter mechanism assembly according to the present invention.

An array of four overlapping shutter blades 10, 20, 30, and 40, as shown in FIG. 7, are arranged radially around the optical axis of the light beam 3 and are positioned to frame the light beam 3. As shown in FIG. 7, the blades 10, 20, 30, and 40 are fully withdrawn or retracted from the path of the light beam 3. The shutter blade 10 is located to the left of the light beam 3 and adjusted so that the intercepting edge 11 is at the edge of the light beam 3 path. The shutter blade 20 is located to the right of the light beam and adjusted so that the intercepting edge 21 is at the edge of the light beam 3 path. The shutter blade 30 is located below the light beam 3 and adjusted so that the intercepting edge 31 is at the edge of the light beam 3 path. The shutter blade 40 is located above the light beam 3 and adjusted so that the intercepting edge 41 is at the edge of the light beam 3 path. Each of the shutter blades 10, 20, 30, and 40 is preferably coupled to a separate driving mechanism, such as shown in FIGS. 2–6, with respect to the shutter blade 10. The driving mechanisms of the blades 10, 20, 30, and 40 will be oriented at 0°, 90°, 180°, and 270° for driving their respective shutter blades linearly in directions displaced by approximately 90° around the periphery of the light beam 3.

The array of shutter blades 10, 20, 30, and 40 can be adjusted by selective adjustment or actuation of each of the blades to form virtually any quadrilateral shape from the light beam 3, in virtually any rotational orientation relative to the optical axis of the beam 3.

Figure 8:
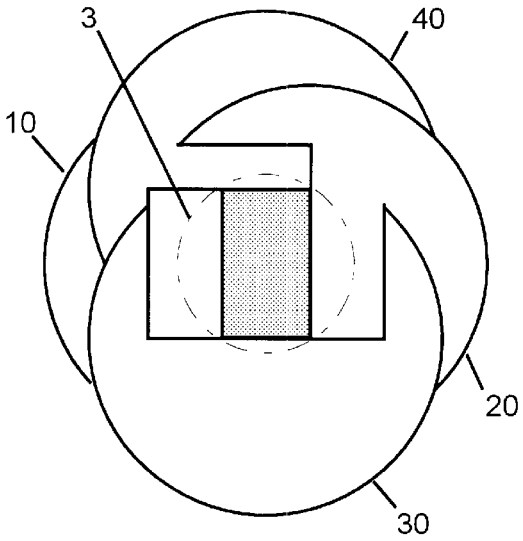

A rectangular pattern is formed as shown in FIG. 8, for example, by driving shutter blade 10 and shutter blade 20 into the light beam 3 path by substantially equal distances, and by driving shutter blade 30 and shutter blade 40 into the light beam 3 path by equal but lesser distances. A square pattern could be formed by driving all four shutter blades 10, 20, 30, and 40 into the light beam 3 path by equal distances.

Figure 9:
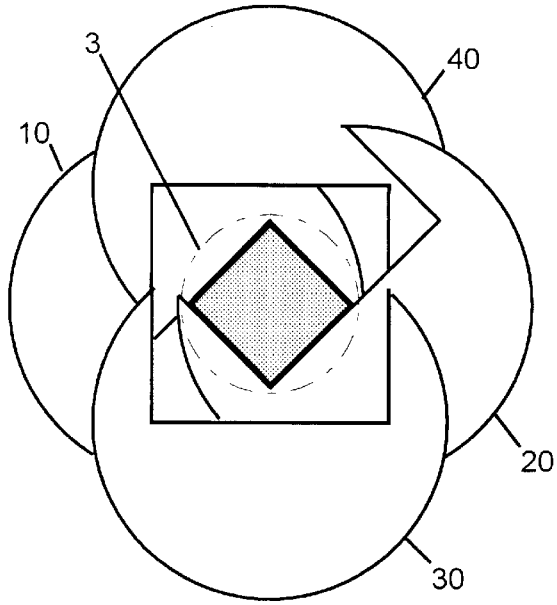

A diamond shaped pattern is formed as shown in FIG. 9, for example, by positioning shutter blades 10 and 20 at opposite edges of the light beam path and then rotating the two shutter blades to 45 degree angles while retracting the blades, to place a corner of the openings defined by the straight edge 11 of each on diametrically opposite sides of the beam 3 and its optical axis. This can be accomplished by retracting the linear driving elements 14 or 15 of the shutter control mechanism 100 of the shutter blades 10 and 20 located on opposite sides of the light beam 3 optical axis while holding the corresponding linear driving element still or extending the corresponding element a substantially shorter distance than the retracted element is moved. Shutter blades 30 and 40 are withdrawn slightly to better illustrate the positions of shutter blades 10 and 20. Alternatively, all four of the shutter blades 10, 20, 30, and 40 can be extended toward the optical axis of the light beam 3 and rotated 45°, so that the straight edge 11 of each shutter blade forms one side of the diamond shape shown.

Figure 10:
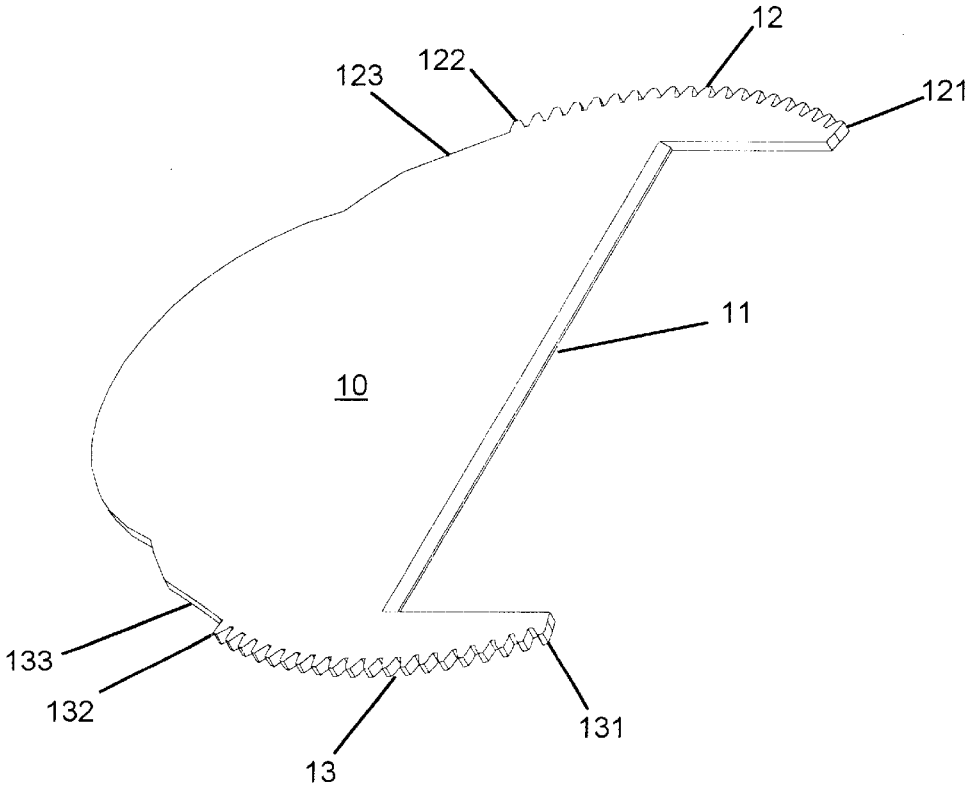
FIG. 10 is a perspective view of a shutter blade according to a preferred embodiment.

In a practical shutter mechanism, shutter blade 10, as shown in FIG. 10, is generally circular but with a rectangular cut-out area bounded by at least one straight edge 11. A first portion of the circumference of the shutter blade is provided with a driven surface 12, which includes gear teeth extending around a portion of the circumference from point 121 to point 122. A second portion of the circumference, opposite the first portion of the circumference, is provided with a driven surface 13, which includes gear teeth extending around a portion of the circumference extending from point 131 to point 132. The depth of the gear teeth comprising driven surfaces 12 and 13 extends closer to the center of the blade 10 than the distance of the peripheral surface of the blade 10 between points 122 and 132 without gear teeth. This configuration allows the peripheral surfaces between points 122 and 132 to act as stops or restraints, preventing the gear teeth of linear driving elements 14 and 15 from rotating the blade beyond points 122 and 132. At points 122 and 132, the gear teeth of respective linear driving elements 14 and 15 will abut the flat stop surfaces 123 and 133 of the blade between points 122 and 132 as the elements are extended, serving as a detente to further extension. It will be apparent that the flat stop surfaces 123 and 133 extend from points 122 and 132, respectively, tangentially to the radius of their adjacent driven surfaces 12 and 13, respectively. Thus, the stop surfaces 123 and 133 abut the linear driving elements 12 or 15, respectively, to interfere with further rotation of the blade 10 substantially beyond their adjacent limits of rotation of blade 10 at points 122 and 132, respectively. Alternatively, or in combination, other structure acting as a stop preventing further extension of linear driving elements 14 and 15 may be secured or formed at points 122 and 132. Shutter blades 20, 30 and 40 are formed identically to shutter blade 10.

A stop may be formed in any of the linear driving element embodiments to limit their travel and prevent the shutter blade driven surfaces 12, 13 from becoming disengaged from the linear driving elements.

Figure 11:
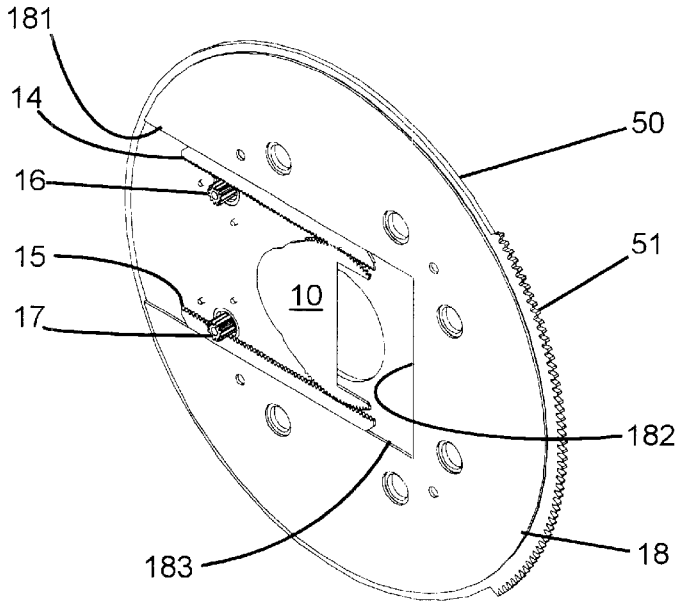
FIG. 11 is a perspective view of a shutter blade mechanism according to a preferred embodiment.

In a practical shutter mechanism, as shown in FIG. 11, shutter blade 10 is coupled to a first linear driving element comprising rack gear 14 having gear teeth formed in one edge thereof for coupling with gear teeth formed in driven surface 12. The shutter blade 10 is also coupled to a second linear driving element comprising rack gear 15, also having gear teeth formed in one edge thereof for coupling with gear teeth formed in driven surface 13. Rack gear 14 is coupled to a first rotary driving element 16 comprising a first pinion. Rack gear 15 is coupled to a second rotary driving element 17 comprising a second pinion. The rack gears and the shutter blade are disposed within a cut-out area within a generally circular spacer plate 18 which guides the movement of the rack gears and the shutter blade. The spacer plate 18 is supported upon a base plate 50, which is generally circular and includes a driven surface 51, comprising gear teeth extending along a portion of the circumference of the base plate.

In this mechanism, the linear driving elements 14 and 15 are maintained along respective tangents to the curvature of shutter blade driven surfaces 12 and 13 throughout the range of travel. Linear driving element 14 is constrained by rotary driving element 16 and the shutter blade 10 to slide along an edge 181 of spacer plate 18. Linear driving element 15 is likewise constrained by rotary driving element 17 and the shutter blade 10, sliding along an edge 183 of spacer plate 18. The linear driving elements support the shutter blade directly within the space formed by the cut-out area, bounded by edges 181, 182 and 183, in the spacer plate, and the shutter blade 10 supports one end each of the two linear driving elements 14 and 15. Within the cut-out area of the spacer plate, bounded by edges 181, 182 and 183, the linear driving elements and the shutter blade are supported in a plane that does not intersect any adjacent shutter blade, as will be described below. This mechanism can be made very thin while still retaining structural integrity and resistance to thermally-induced deformity.

Figure 12:
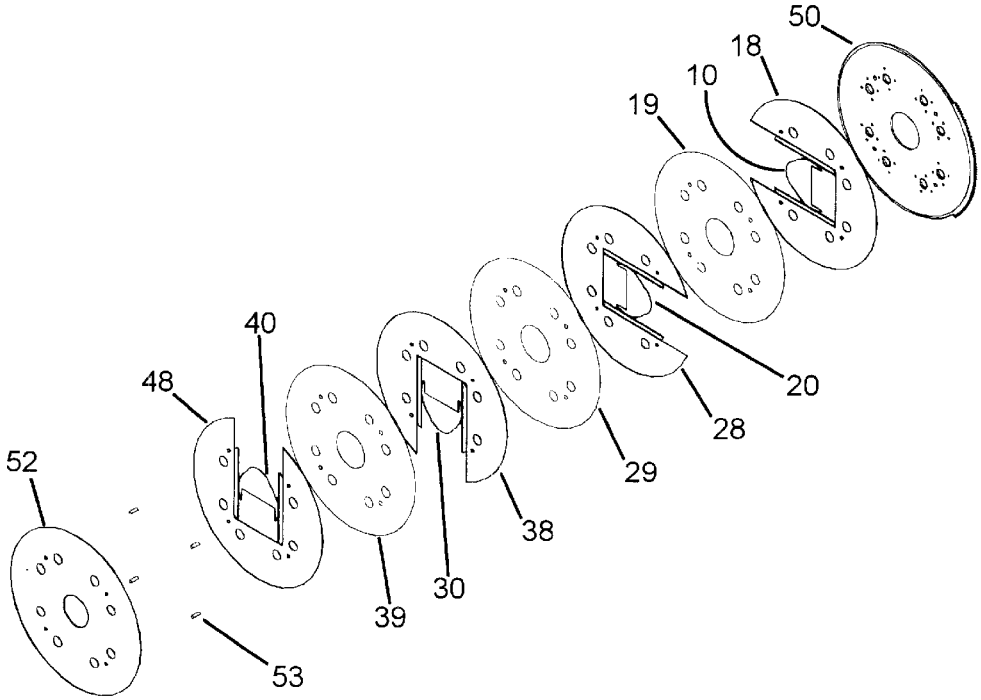
FIG. 12 is a perspective view of components of a shutter mechanism assembly.

A practical shutter mechanism assembly, as shown in an exploded view in FIG. 12, includes four layers of shutter mechanisms supported on a base plate 50 and captured by a top plate 52. A first shutter mechanism comprising shutter blade 10 and rack gears 14, 15 is disposed within a first spacer plate 18 and mounted directly upon base plate 50. A first separator plate 19 is mounted over the first shutter mechanism and serves to restrain the shutter blade and rack gears within the cut-out area of the spacer plate. A second shutter mechanism comprising shutter blade 20 and rack gears 24, 25 is disposed within a second spacer plate 28 and mounted upon separator plate 19. A second separator plate 29 is mounted over the second shutter mechanism and serves to restrain the shutter blade and rack gears within the cut-out area of their respective spacer plate. A third shutter mechanism comprising shutter blade 30 and rack gears 34, 35 is disposed within a third spacer plate 38 and mounted upon separator plate 29. A third separator plate 39 is mounted over the third shutter mechanism and serves to restrain the shutter blade and rack gears within their respective spacer plate. A fourth shutter mechanism comprising shutter blade 40 and rack gears 44, 45 is disposed within a fourth spacer plate 48 and mounted over separator plate 39. The top plate 52 mounted over the spacer plate 48 serves to restrain the shutter blade and rack gears within their respective spacer plate and captures the four layers of shutter mechanisms within a shutter mechanism assembly. The top plate 52 is preferably secured to the base plate 50 by suitable fasteners 53.

Figure 13:
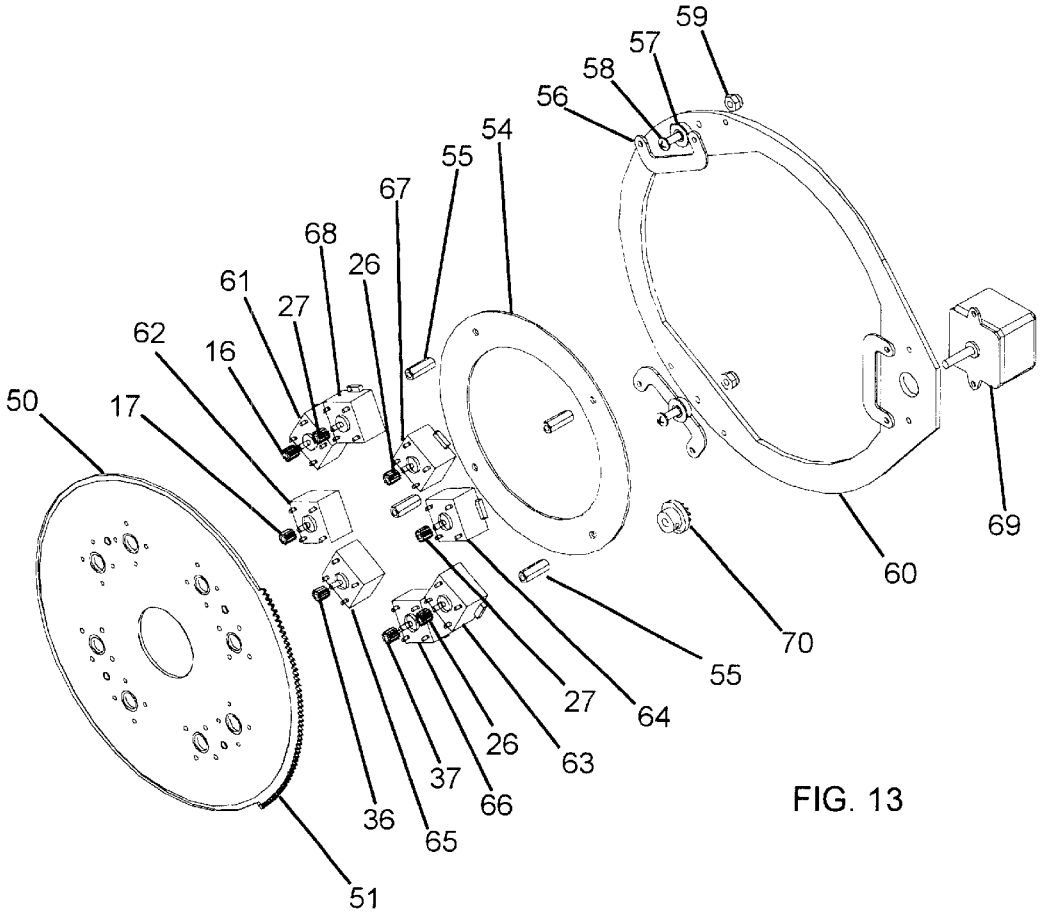
FIG. 13 is a perspective view of components of a motor drive assembly.

In a practical motor drive assembly, motors and pinions for driving the rack gears are installed from an opposite side of base plate 50, as shown in FIG. 13. Pinion 16 is mounted on the rotary shaft of motor 61 and pinion 17 is mounted on the shaft of motor 62. Motors 61 and 62 are selectively energized for adjusting the position of shutter blade 10 through the coupling of pinions 16, 17 through rack gears 14, 15 to shutter blade driven surfaces 12, 13. Motors 63 and 64 similarly drive shutter blade 20 through pinions 26, 27, and the corresponding rack gears associated with shutter blade 20. Motors 65 and 66 similarly drive shutter blade 30 through pinions 36, 37 and the corresponding rack gears associated with shutter blade 30. Motors 67 and 68 similarly drive shutter blade 40 through pinions 46, 47 and the corresponding rack gears associated with shutter blade 40.

Mounting holes formed in the base plate 50, and corresponding holes formed in the various spacer plates and separator plates, permit passage of the pinions through the various plates for coupling with gear teeth of the various rack gears. Other mounting holes formed in the base plate permit attachment of the motors to the base plate by suitable fasteners in a manner well-known in the mechanical arts. A common and expedient method of attachment is by way of machine screws passing through mounting holes formed in the motor housings and threaded into tapped holes formed in the base plate. Other methods of attachment might also be used. A retaining ring 54 is attached to the base plate 50 via standoffs 55, and serves to support the motors 61–68 from behind. Stepper motors are preferred to accurately position the rack gears, although servomotor systems will also work.

Figure 14:
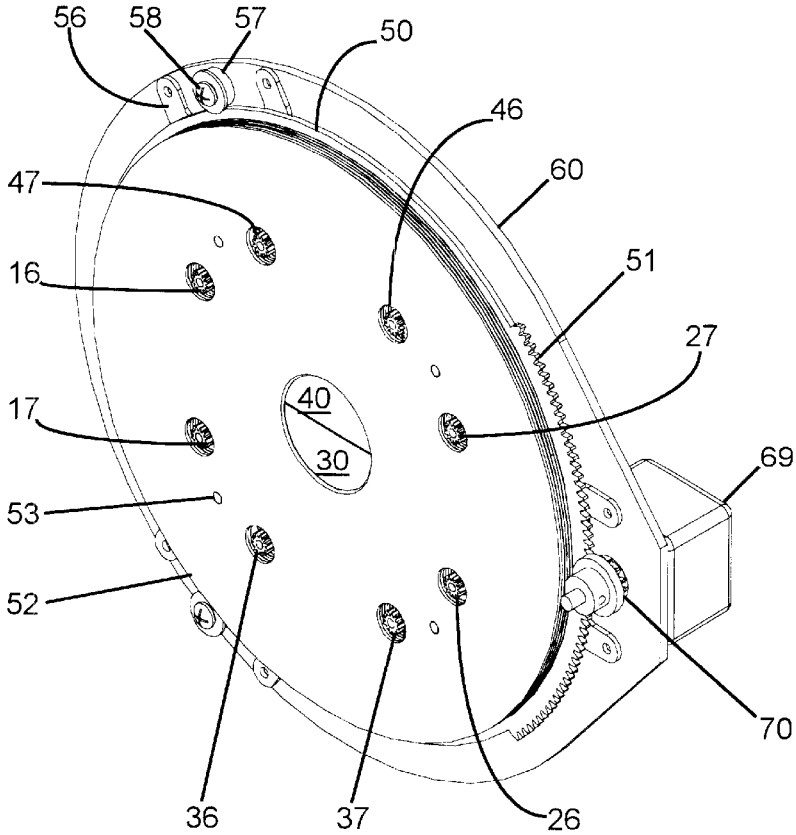
FIG. 14 is a perspective view of a light beam shutter apparatus according to a preferred embodiment.

In a practical light beam shutter apparatus as shown in FIG. 14, the base plate 50 carrying the shutter mechanism assembly is supported on a mounting ring 60. The base plate 50 rides on rollers 57, which are secured to the mounting ring by suitable fasteners, such as machine screw 58 and nut 59, as shown in FIG. 13 and FIG. 14. Rollers 57 are provided at two locations around mounting ring 60, but a drive sprocket 70 is provided at a third location, supported on a motor 69, which is also secured to the mounting ring 60. Drive sprocket 70 is coupled to gear teeth on the driven surface 51 of base plate 50. Bearing plates 56 interposed between base plate 50 and mounting ring 60 provide clearance between the base plate and the mounting ring. The base plate then rides on the rollers 57 and is driven for rotation about a central axis by drive sprocket 70. In operation, motor 69 is selectively energized to rotate the shutter mechanism assembly through approximately 90 degrees of travel so the overall angular position of the pattern formed by shutter blades 10, 20, 30, and 40 can be adjusted as desired.

An alternate embodiment shown in FIGS. 15–19 utilizes a single motor to drive a pair of flexible tracks that engage the shutter blade on opposing sides.

Figure 15:
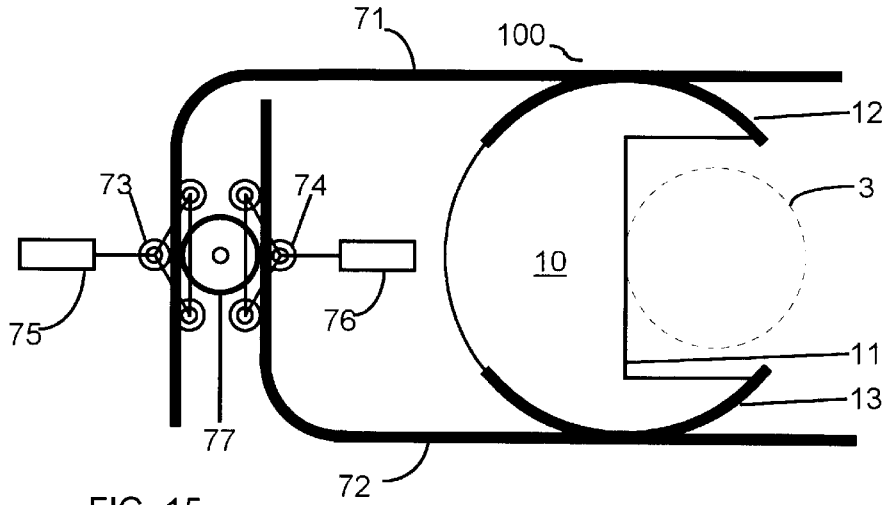
FIGS. 15–19 are diagrams showing the operation of the shutter blade mechanism according to a second embodiment.

As shown in FIG. 15, a first linear driving element comprising a first flexible track 71 engages the shutter blade 10 on driven surface 12. The first flexible track passes through a first set of idler rollers 73, which holds the first flexible track in engagement with a rotary driving element comprising a drive pinion 77. The first set of idler rollers 73 is coupled to a first solenoid 75, which is operable to withdraw the idler rollers and flexible track away from the drive pinion. A second linear driving element comprising a second flexible track 72 engages the shutter blade 10 on driven surface 13 which is opposite driven surface 12. The second flexible track passes through a second set of idler rollers 74, which holds the second flexible track in engagement with the drive pinion 77. The second set of idler rollers 74 is coupled to a second solenoid 76, which is operable to withdraw the idler rollers and flexible track away from the drive pinion.

Figure 16:
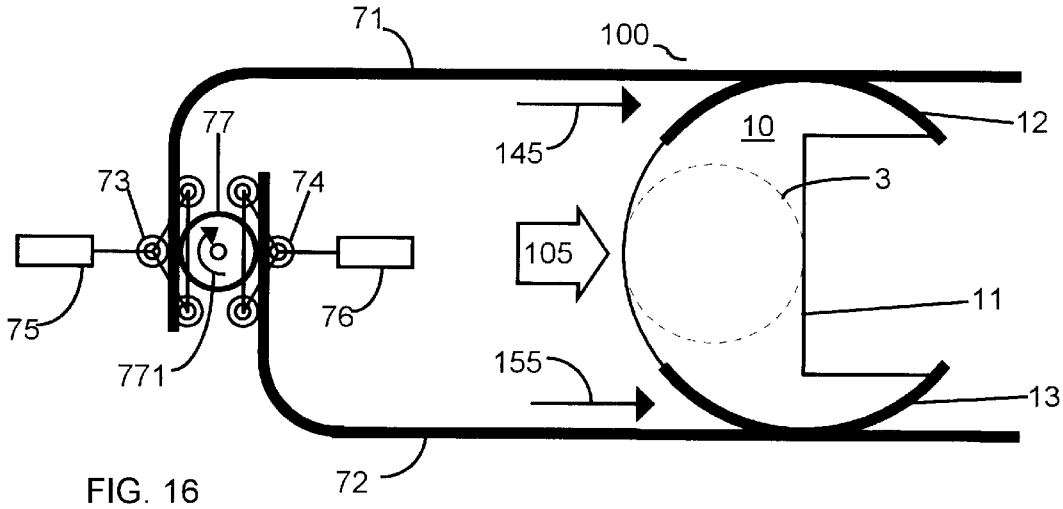

When the pinion 77 is rotated in the direction shown by arrow 771 (FIG. 16), the flexible tracks 71, 72 are moved in directions shown by arrows 145 and 155, respectively, the action of which carries shutter blade 10 in a direction shown by arrow 105. The position of shutter blade 10 as shown in FIG. 16 completely intercepts light beam 3 and represents a limit of practical travel for the shutter blade mechanism.

Figure 17:
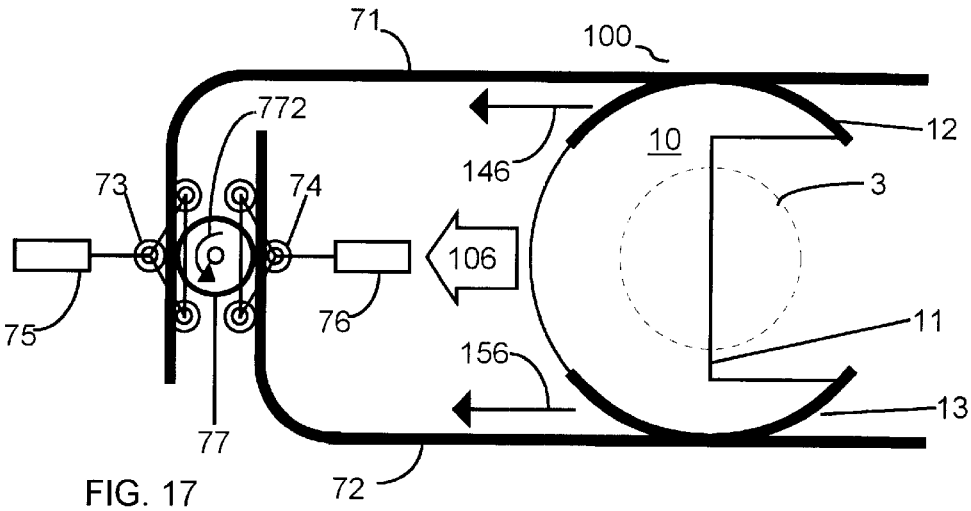
Figure 18:
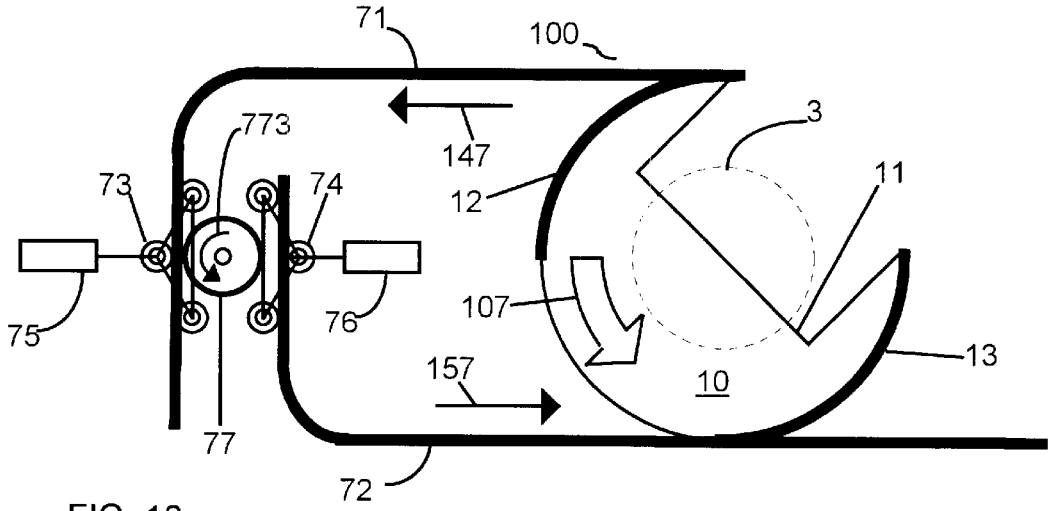
Figure 19:
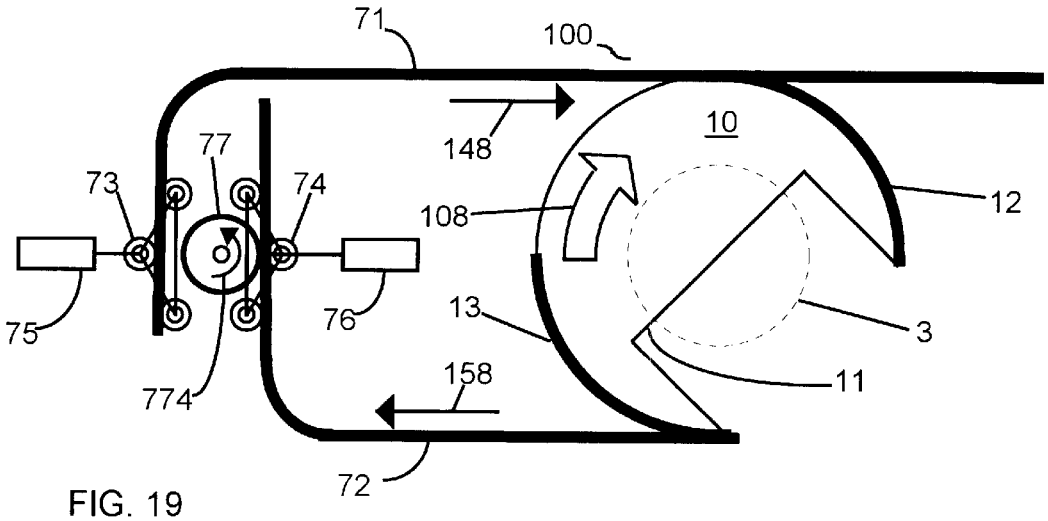

When the pinion 77 is rotated in the direction shown by arrow 772 (FIG. 17), the flexible tracks 71, 72 are moved in directions shown by arrows 146 and 156, respectively, the action of which carries shutter blade 10 in a direction shown by arrow 106. The position of shutter blade 10, as shown in FIG. 17, intercepts half of light beam 3 and represents a midpoint of practical travel for the shutter blade mechanism. If pinion 77 continues to rotate in the direction shown by arrow 772, the shutter blade 10 will eventually be carried back to the position shown in FIG. 16.

Rotation of the shutter blade 10 is accomplished by actuating either one of the solenoids 75 or 76 to withdraw one or the other set of idler rollers 73 or 74 and thereby disengage either the first or the second flexible track 71 or 72 from the pinion 77; whereupon rotation of pinion 77 results in rotation of the shutter blade 10, as explained below. The direction of rotation of the shutter blade is dependent upon which flexible track is disengaged from the pinion, and is also dependent upon the direction of rotation of the pinion.

With the shutter blade 10 in a midpoint position, as shown in FIG. 17, the second solenoid 76 can be actuated to withdraw the second set of idler rollers 74 and thereby disengage second flexible track 72 from the pinion 77. Thereafter, rotation of pinion 77 in a direction shown by arrow 773 (FIG. 18) moves the first flexible track 71 in a direction shown by arrow 147, the action of which causes rotation of shutter blade 10 in a direction shown by arrow 107. As a consequence of the rotation of the shutter blade, the second flexible track 72 moves in a direction shown by arrow 157 while the second flexible track 72 is disengaged from the pinion 77.

With the shutter blade 10 in a midpoint position, as shown in FIG. 17, the first solenoid 75 can be actuated to withdraw the first set of idler rollers 73 and thereby disengage first flexible track 71 from the pinion 77. Thereafter, rotation of pinion 77 in a direction shown by arrow 774 (FIG. 19) moves the second flexible track 72 in a direction shown by arrow 158, the action of which causes rotation of shutter blade 10 in a direction shown by arrow 108. As a consequence of the rotation of the shutter blade, the first flexible track 71 moves in a direction shown by arrow 148 while the first flexible track 71 is disengaged from the pinion 77.

Other drive arrangements may be possible whereby a linear driving element engages the shutter blade on one edge of the circumference thereof while a second linear driving element engages the opposite edge. The linear driving elements may also be driven by linear-actuating motors in place of rotary motors. A manually-operated light beam shutter apparatus can be constructed substituting levers and mechanical linkages for the motors coupled to the linear driving members.

Figure 20:
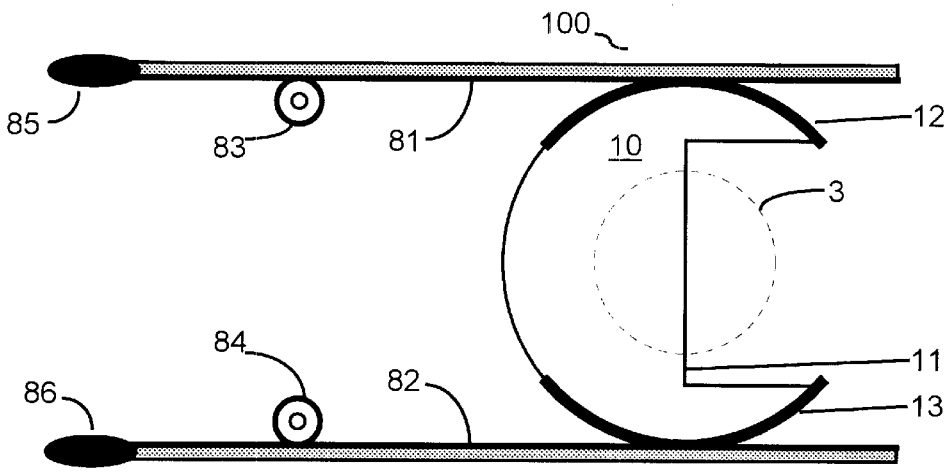
FIG. 20 is a diagram showing a shutter blade mechanism according to another embodiment.

A manually-operated shutter mechanism, as shown in FIG. 20, includes a first linear driving element 81 engaging shutter blade 10 on a first circumferential edge driven surface 12 and a second linear driving element 82 engaging shutter blade 10 on a second circumferential edge driven surface 13. A first idler roller 83 supports the first linear driving element 81 so the linear driving element is maintained along a given tangent to the curvature of shutter blade driven surface 12 throughout its range of travel. A second idler roller 84 likewise supports the second linear driving element 82, maintaining the linear driving element along a tangent to the curvature of shutter blade driven surface 13 throughout its range of travel. A handle 85 is provided on one end of first linear driving element 81, which is made to extend through the exterior housing of a luminaire so the handle is accessible. A similar handle 86 is provided on one end of second linear driving element 82, which also extends through the exterior housing of a luminaire so the handle 86 is accessible. In a practical apparatus, the shutter blade and linear driving members will be supported and constrained in a manner similar to that shown in FIGS. 11 and 12 within suitably designed spacer plates and separator plates.

Figure 21:
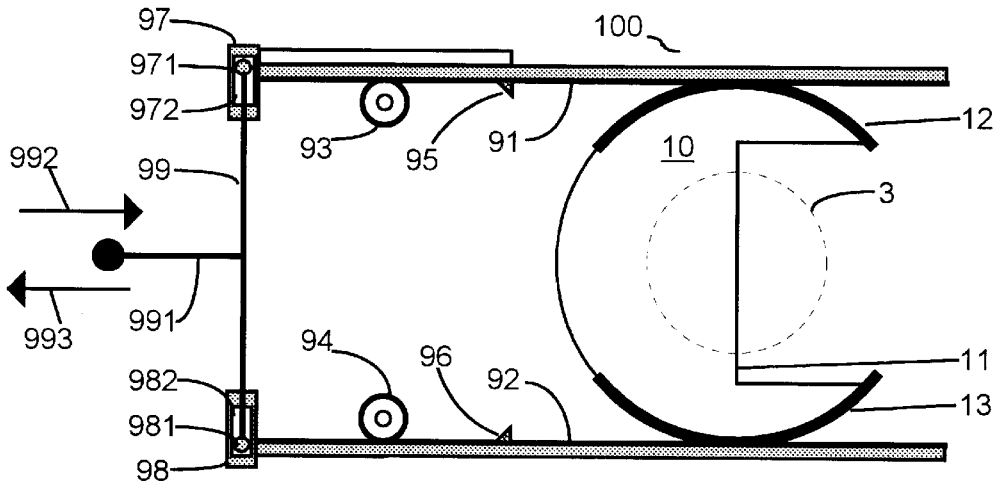
FIGS. 21–23 are diagrams showing a shutter blade mechanism according to yet another embodiment.

Another manually-operated shutter mechanism, as shown in FIG. 21, includes a first linear driving element 91 engaging shutter blade 10 on a first circumferential edge driven surface 12 and a second linear driving element 92 engaging shutter blade 10 on a second circumferential edge driven surface 13. A first idler roller 93 supports the first linear driving element 91 so the linear driving element is maintained along a given tangent to the curvature of shutter blade driven surface 12 throughout its range of travel. A small hook 95 is formed on the first linear driving element 91 at a position designed to abut the first idler roller 93 when the limit of travel is reached. A second idler roller 94 likewise supports the second linear driving element 92, maintaining the linear driving element along a tangent to the curvature of shutter blade driven surface 13 throughout its range of travel. A second small hook 96 is formed on the second linear driving element 92 at a position designed to abut the second idler roller 94 when the limit of travel is reached.

A first slotted hinge assembly 97 provided on one end of the first linear driving element 91 and a second slotted hinge assembly 98 provided on one end of the second linear driving element 92 are connected by a crossbar assembly 99. The crossbar assembly 99 includes, on one end thereof, a first pin 971, which slides within a slot 972 formed in the first hinge assembly 97. A second pin 981 is provided on an opposite end of the crossbar assembly 99, and slides within a slot 982 formed in the second hinge assembly 98. The crossbar assembly 99 further includes a handle 991, which is made to extend through the exterior housing of a luminaire so the handle is accessible.

Figure 22:
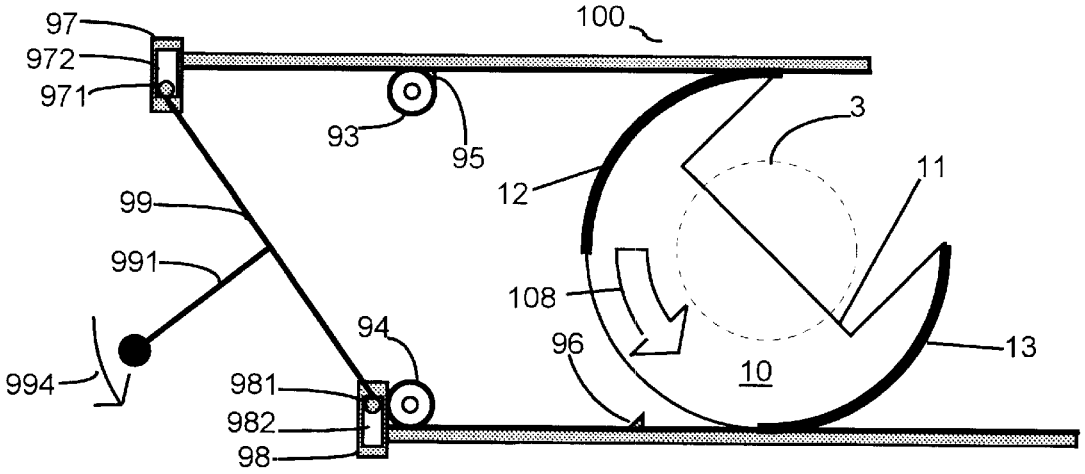
Figure 23:
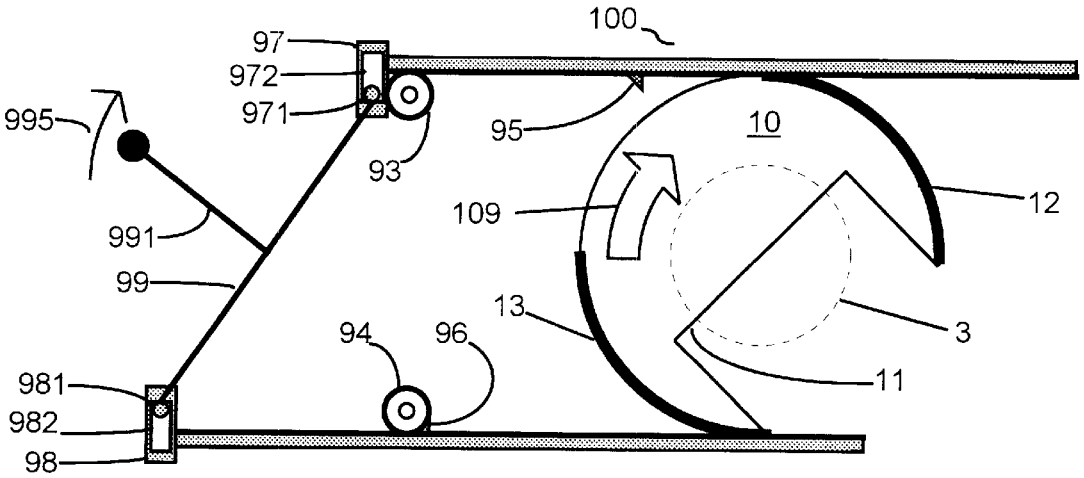

The operation of this manually-operated shutter mechanism is shown in FIGS. 22 and 23. Push handle 99 in (the direction shown by arrow 992) to extend the shutter blade 10 into the light beam, and pull the handle 99 out (the direction shown by arrow 993) to withdraw the shutter blade 10 from the light beam. Pivot handle 99 down (the direction shown by arrow 994) to rotate the shutter blade 10 in a counterclockwise direction (as shown in FIG. 22) and pivot handle 99 up (the direction shown by arrow 995) to rotate shutter blade 10 in a clockwise direction (as shown in FIG. 23). The mechanism is constructed so that the distance between each slotted hinge assembly (97, 98) and the corresponding small hook (95, 96) provided on the linear driving elements (91, 92) corresponds to the limits of travel of the linear diving elements. As shown in FIG. 22, the slotted hinge assembly 98 abuts the second idler roller 94 and the first small hook 95 abuts the first idler roller 93, thereby limiting any further rotation of the shutter blade 10. A similar but reversed situation is shown in FIG. 23. It will be appreciated that the two small hooks 95, 96 limit the range of travel when withdrawing the shutter blade 10 from the light beam 3 (FIG. 21, direction 993), while the slotted hinge assemblies 97, 98 limit the range of travel when extending the shutter blade 10 into the light beam 3 (FIG. 21, direction 992).

It will be appreciated that the manually-actuated embodiments of FIGS. 20, 21, 22, and 23 can alternatively be operated with one or more powered actuators operatively connected to handles 85, 86 and 991, either directly or through suitable linkage mechanisms.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

I claim:

1. A light beam shutter apparatus for a lighting instrument, the light beam shutter apparatus comprising:

a plurality of shutter mechanisms, each of said shutter mechanisms comprising:

a shutter blade in the general form of a disk having a circumference and a center, said disk having a cut-out or void portion formed therein such that a portion of the circumference of the disk is eliminated by the cut-out or void portion thereof;

at least one edge formed in said shutter blade, said edge passing through said center and forming a boundary of said cut-out or void portion, said edge provided for intercepting at least a portion of a beam of light;

a pair of driven surfaces formed in the circumference of said shutter blade;

a pair of linear driving elements, each of said linear driving elements being coupled to said shutter blade at one of said pair of driven surfaces.

2. The light beam shutter apparatus of claim 1, further including at least one rotary driving element coupled to one of said linear driving elements.

3. The light beam shutter apparatus of claim 2, further including an actuator coupled to each of said linear driving elements, said actuator operable to engage or disengage said linear driving element to said rotary driving element.

4. The light beam shutter apparatus of claim 2, wherein each linear driving element is coupled to a respective rotary driving element.

5. The light beam shutter apparatus of claim 2, wherein said driven surface formed in the circumference of said shutter blade includes gear teeth, said pair of linear driving elements comprise rack gears and said at least one rotary driving element comprises a pinion.

6. The light beam shutter apparatus of claim 1, wherein said plurality of shutter mechanisms includes four such mechanisms arranged radially about an axis of the beam of light.

7. A light beam shutter mechanism for shaping a beam of light, comprising:

a shutter blade having curved first and a second driven surfaces located on generally opposite sides of the blade, the shutter blade having an edge for intercepting at least a portion of a light beam projected by the lighting instrument;

first and second linear driving elements, each for engaging the shutter blade at one or more points of contact with the respective first and second driven surfaces; and one or more actuators for displacing the first and second linear driving elements substantially linearly to extend and retract the shutter blade toward and away from the beam of light and to rotate the shutter blade with respect to the beam of light.

8. The light beam shutter mechanism of claim 7, wherein at least one of the actuators comprises a rotary driving element engaging either or both of the first and second linear driving elements and wherein rotation of the rotary driving element displaces the linear driving element to which the rotary driving element is coupled along a substantially linear path that is tangential to the first or second driven surfaces of the shutter blade to which the linear driving element engages.

9. The light beam shutter mechanism of claim 8, wherein the first and second linear driving elements each have a set of gear teeth and wherein the rotary driving element has a set of gear teeth engaging the gear teeth of either or both of the first and second linear driving elements to effect linear and rotational actuation of the shutter blade.

10. The light beam shutter mechanism of claim 7, wherein at least a portion of each of the first and second driven surfaces contacting the first and second linear driving elements of the shutter blade are each substantially circular and share substantially the same center of curvature.

11. The light beam shutter mechanism of claim 7, wherein one or more of the actuators linearly actuate the first and second linear driving elements synchronously to extend and retract the shutter blade.

12. The light beam shutter mechanism of claim 11, wherein one or more of the actuators linearly actuate the first and second linear driving elements in substantially the same direction and at substantially the same speed toward and away from the beam of light to extend and retract the shutter blade.

13. The light beam shutter mechanism of claim 11, wherein the first and second linear driving elements support the shutter blade for extension and retraction toward and away from the beam of light.

14. The light beam shutter mechanism of claim 7, wherein the one or more actuators linearly actuate the first and second linear driving elements asynchronously to rotate the shutter blade.

15. The light beam shutter mechanism of claim 7, wherein the one or more actuators linearly actuate the first and second linear driving elements asynchronously to both rotate and linearly actuate the shutter blade.

16. The light beam shutter mechanism of claim 14, wherein one or more of the actuators linearly actuate the first and second linear driving elements in substantially opposite directions and at substantially the same rate of movement to rotate the shutter blade.

17. The light beam shutter mechanism of claim 15, wherein one or more of the actuators linearly actuate the first and second linear driving elements in substantially opposite directions and at different rates of movement to rotate and linearly actuate the shutter blade.

18. The light beam shutter mechanism of claim 8, further including one or more coupling actuators for engaging and disengaging one or both of the first and second linear driving elements with one or more of the rotary driving elements.

19. The light beam shutter mechanism of claim 8, wherein the first and second linear driving elements are each coupled to a rotary driving element.

20. The light beam shutter mechanism of claim 7, wherein the first linear driving element is displaced by one or more of the actuators independently of the second linear driving element, to effect rotation of the shutter blade.

21. The light beam shutter mechanism of claim 7, wherein the first and second driven surfaces of the shutter blade includes gear teeth, wherein the first and second linear driving elements each comprise a rack gear and wherein one or more of the rotary driving elements comprise a pinion.

22. The light beam shutter mechanism of claim 7, wherein the edge of the shutter blade forms a cut-out or void portion extending inwardly from the periphery of the shutter blade.

23. The light beam shutter mechanism of claim 22, wherein the void portion of the shutter blade forms a rectangular opening, having a straight edge substantially aligned with the center of the axis about which the shutter blade is rotated by the linear driving elements.

24. The framing apparatus of claim 22, wherein the beam of light is projected through the void portion of the shutter blade substantially without obstruction when the shutter blade is in a retracted position.

25. The framing apparatus of claim 22, wherein the beam of light is completely obstructed by the shutter blade when the shutter blade is in an extended position.

26. The framing apparatus of claim 23, wherein the beam of light is projected through the void portion of the shutter blade substantially without obstruction when the shutter blade is in a retracted position.

27. The framing apparatus of claim 23, wherein the beam of light is completely obstructed by the shutter blade when the shutter blade is in an extended position.

28. The light beam shutter mechanism of claim 7, wherein at least a portion of the edge of the shutter blade has a non-linear profile.

29. The light beam shutter mechanism of claim 7, wherein the edge of the shutter blade is straight.

30. The light beam shutter mechanism of claim 7, wherein one or more actuators for displacing the first and second linear driving elements substantially linearly to extend and retract the shutter blade toward and away from the beam of light and to rotate the shutter blade with respect to the beam of light comprises a linear actuator.

31. The light beam shutter mechanism of claim 7, wherein one or more actuators for displacing the first and second linear driving elements substantially linearly to extend and retract the shutter blade toward and away from the beam of light and to rotate the shutter blade with respect to the beam of light comprises a manual lever actuator.

32. The light beam shutter mechanism of claim 31, further comprising a mechanical linkage secured to the manual lever actuator and coupled by a hinge to each of the first and second linear driving elements.

33. The light beam shutter mechanism of claim 7, wherein the shutter blade comprises one or more stops to prevent the first and second linear driving elements from contacting the periphery of the shutter blade beyond the first and a second driven surfaces.

34. The light beam shutter mechanism of claim 7, further comprising rotational limitation means for limiting rotation of the shutter blade.

35. The light beam shutter mechanism of claim 34, wherein the first and second linear driving elements each have a set of gear teeth engaging gear teeth forming at least a portion of the respective first and second driven surfaces and the rotational limitation means comprises a portion of the periphery of the shutter blade adjacent the each of the first and second driven surfaces which the gear teeth of the first and second linear driving elements will not engage.

* * * * *